United States Patent [19]

Kotter

[11] Patent Number: 4,958,476

[45] Date of Patent: Sep. 25, 1990

[54] ADAPTIVE ARCHITECTURAL COVER PANEL SYSTEM

[76] Inventor: Rodman W. Kotter, 10815 Molony Rd., Culver City, Calif. 90230

[21] Appl. No.: 355,788

[22] Filed: May 19, 1989

Related U.S. Application Data

[62] Division of Ser. No. 174,516, Mar. 28, 1988, abandoned.

[51] Int. Cl.[5] ..... E04G 21/14

[52] U.S. Cl. ..... 52/745; 29/453; 52/80; 52/732; 52/724

[58] Field of Search ..... 52/730–732, 52/724, 725, 727, 728, 107, 741, 745, 80; 29/453, 155 R, 525.1

[56] References Cited

U.S. PATENT DOCUMENTS

| | | | |
|---|---|---|---|
| 943,306 | 12/1909 | Harry | 138/156 |
| 1,049,543 | 6/1913 | Smith | 405/124 |
| 1,231,348 | 6/1917 | Hernandez | 52/323 |
| 1,585,266 | 5/1926 | Schafly | 285/405 |
| 3,477,894 | 11/1969 | Graff et al. | 156/459 |
| 3,638,434 | 2/1972 | Deleare | 405/126 |
| 4,401,705 | 8/1983 | Ewert | 428/182 |

FOREIGN PATENT DOCUMENTS

| | | | |
|---|---|---|---|
| 606670 | 3/1926 | France | 138/159 |
| 1280028 | 11/1961 | France . | |
| 1340142 | 9/1963 | France . | |

*Primary Examiner*—James L. Ridgill, Jr.

*Attorney, Agent, or Firm*—Pretty, Schroeder, Brueggemann & Clark

[57] ABSTRACT

An architectural cover panel system of individually adaptive panels for covering structural support members of an underlying structure such as girders. An individual adaptive panel includes a sheet of flexible material having a generally convex cross-section and is provided with corrugations oriented perpendicular to the longitudinal axis of the panel. In one preferred embodiment the convex panel is provided with edged portions attached to the lateral sides of the panel. The edge portions are similarly provided with corrugations oriented parallel to and intersecting or merging into the corrugations of the convex panel portion.

5 Claims, 1 Drawing Sheet

FIG. 1.
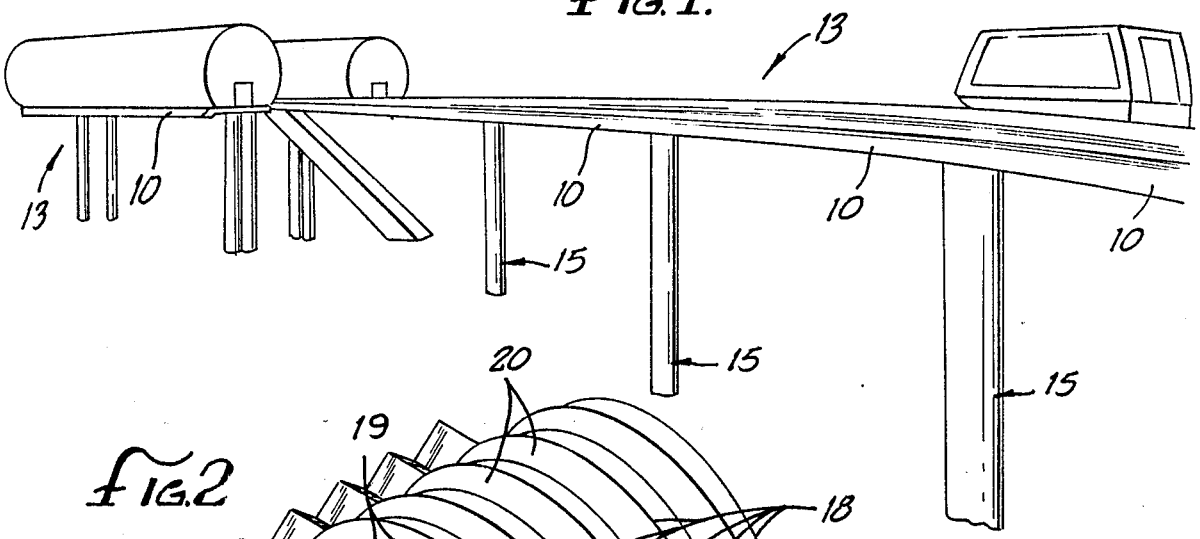
FIG. 2
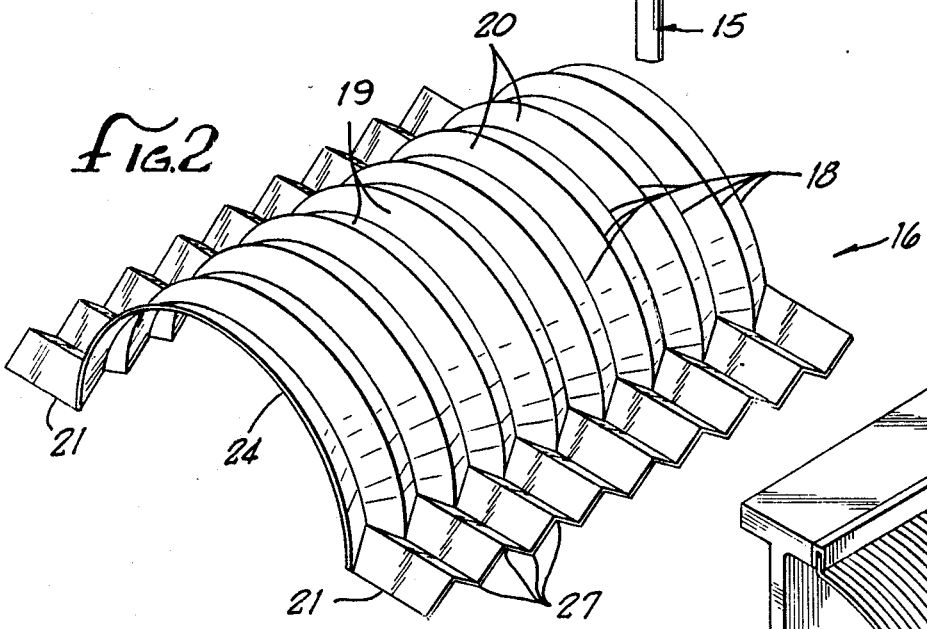
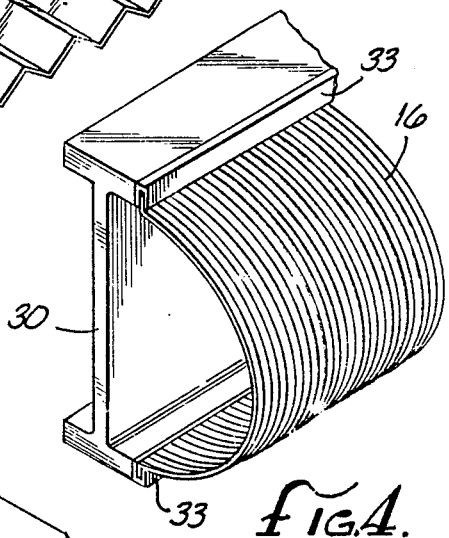
FIG. 4.
FIG. 3.
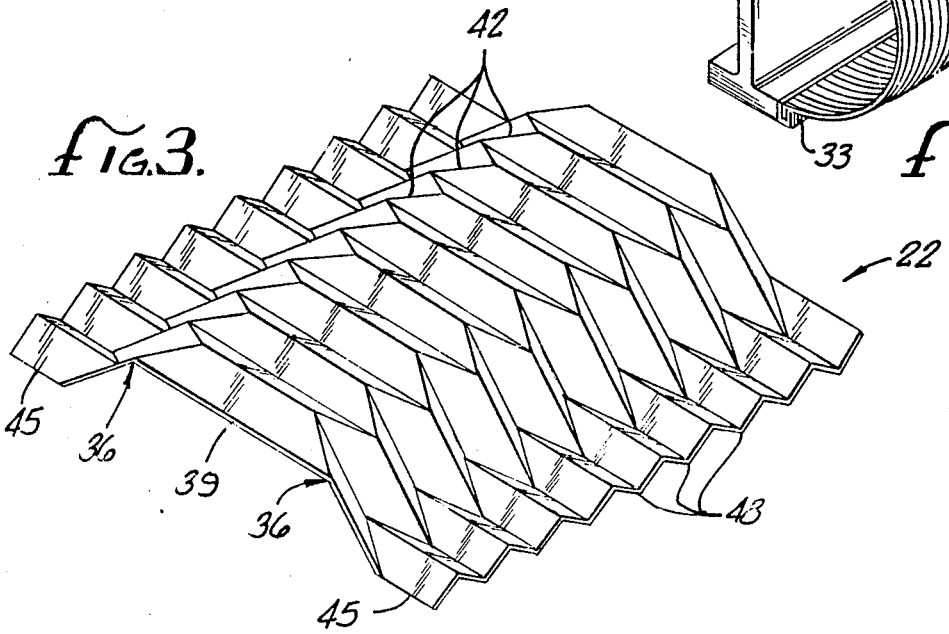

ADAPTIVE ARCHITECTURAL COVER PANEL SYSTEM

This is a divisional application of co-pending application Ser. No. 07/174,516 filed on Mar. 28, 1988 now abandoned.

BACKGROUND OF THE INVENTION

The present invention concerns architectural structures, and more particularly, relates to an architectural cover panel system for covering structural support members Architectural cover panels are typically employed to provide aesthetically pleasing coverings over structural support members such as bridge girders and building beam members such as I-beams. These cover panels also provide some protection to the structural support member from the elements and may otherwise serve to seal the underlying support structure from intrusions, such as for example bird nestings.

Conventional architectural cover panels are generally configured as flat sheets of relatively thick material which are attached to an exposed side of a structural support member. One example of a conventional architectural cover panel is illustrated in U.S. Pat. No. 3,538,664 to L. Frandsen et al. conventional architectural cover panels require significant rigidity and strength to resist wind loading forces which could otherwise dismember or dislodge the panel. Accordingly, conventional cover panels can add significant weight to the entire load supported by the underlying structural member. Fitting conventional architectural cover panels to a structural support member can also be an expensive, labor and time intensive effort since the panels have to be cut and trimmed in order to fit a variety of complex curves and shapes of the structural support member. Thus there still exists a need for a light-weight architectural cover panel which is adaptable to the varying dimensions and shapes of differing structural support members but adequately resistant to wind loading forces.

SUMMARY OF THE INVENTION

Briefly, and in general terms, the present invention provides a light-weight architectural cover panel system which is both resistant to wind loading forces and also readily adaptable to structural support members having a variety of dimensions and surface shapes without excessive trimming or cutting of individual panels.

More specifically, the present invention resides in a system of adaptive architectural cover panels made from relatively thin sheet material and formed in a generally convex cross-sectional shape, whether of curved or angular configuration or otherwise. The panels are provided with corrugations lying in the cross-sectional plane, allowing the panel the flexibility to either expand or contract along any desired axis so as to conform to the shape of a structural support member while further providing significant reinforcement against wind loading forces. Adjacent panels may be overlapped or nested at their ends with the result that a plurality of panels can be efficiently and economically joined contiguously to attractively cover the full extent of a complexly shaped structure.

In one preferred embodiment of the architectural cover panel system of the present invention, the individual panels further may be provided with edge portions projecting from the longitudinal margins or sides of the convex portion of the panels. The edge portions also may be corrugated, with these corrugations lying generally parallel to and intersecting the corrugations of the convex panel portion. The edge portions provide a simple method of attaching the panel to a structural support member and further provide additional resistance to wind loading forces.

The novel features which are believed to be characteristic of the present invention, together with further objectives and advantages thereof, will be better understood from the following detailed description considered in connection with the accompanying drawings, wherein like numbers designate like elements It should be expressly understood, however, that the drawings are for purposes of illustration and description only and are not intended as a definition of the limits of the invention.

BRIEF DESCRIPTION OF THE DRAWINGS

FIG. 1 is a perspective view of the adaptive architectural cover panel system of the present invention installed over an illustrative architectural structure;

FIG. 2 is a perspective view of one preferred embodiment of an individual adaptive architectural cover panel of the present invention;

FIG. 3 is a perspective view of yet another preferred embodiment of an individual adaptive architectural panel of the present invention;

FIG. 4 is a perspective view of the individual architectural panel illustrated in FIG. 2 attached to an exemplary structural support member.

DETAILED DESCRIPTION OF THE INVENTION

Referring to the figures, and more particularly FIG. 1 thereof, there is shown an illustrative application of the present inventive adaptive architectural panel system 10 covering the edges of structural support members 13 forming a monorail track and monorail station platform. The ends of adjacent panels 10 may be overlapped and nested to obscure the junctures of the panels and provide a cleaner, more aesthetically appealing architectural appearance to the underlying support members. Although relatively light, and therefore adding little to the load born by the structural support members 13, the panels 10 are still sufficiently strong to resist normal wind loading.

One preferred embodiment of an individual panel 16 that forms part of the panel system 10 is more fully illustrated in FIG. 2. As shown, the panel 16 is made from a square or generally rectangular sheet of relatively thin material and is formed into a panel having a generally convex cross-section. The panel 16 is also provided with a plurality of corrugations 18, oriented perpendicular to a longitudinal axis of the panel and parallel to the plane of the panel cross-section. The corrugations 18 add enhanced flexibility to the panel 16 while simultaneously providing additional structural reinforcement. The configurations illustrated in FIG. 2 characterize only one type of fold pattern contemplated by the present invention. As illustrated, the corrugations of the panel 16 provide generally flat surfaces 19 meeting at varying angles with alternating surfaces 20 lying in essentially parallel planes. Other corrugation patterns could also be used such as, for example, where the alternating flat surfaces 20 would lie in non-parallel planes and every third flat surface would lie in the same plane.

The corrugations permit expansion or contraction along the entire width and length of the panel 16 to accommodate support members 13 of varying dimensions, and further allow for localized panel expansion or contraction so as to conform the panel 16 to the surface curvature of the support member 13. Thus, the corrugations allow the same adaptive cover panel 16 to be used in conjunction with several different types of structural support members of varying dimensions and surface shapes without the need for excessive cutting or trimming. At the same time, however, the corrugations further permit use of lighter materials, such as sheet metals, plastics or composite materials, for the construction of the panel 16 while still retaining sufficient rigidity to resist wind loading. The corrugations 18 also facilitate the overlapping placement of adjacent panels 16 so as to obscure the junction of the panels 16 and provide cleaner architectural lines as discussed above. Differences in the thermal expansion coefficients of the panels 16 and support members 13 are also accommodated by the adaptive expansion and contraction of the panels 16.

In the preferred embodiment illustrated in FIG. 2, the panel 16 is further provided with edge portions 21 projecting from the longitudinal sides of the convex body portion 24. The edge portions 21 are also provided with corrugations 27 which are oriented perpendicular to the longitudinal axis of the panel and thus lie parallel to and intersect with or merge into the corrugations 18 of the convex body portion 24 in an "intercorrugated" manner, as shown in FIG. 2, whereby the corrugations 27 of the edge portions 21 are formed reversely to the corrugations 18 of the convex body portion 24. These edge portions 21 permit the adaptive panels 16 to be very easily mounted on to a structural support member while maintaining the adaptive character of the panel 16 and adding to its wind loading resistance.

As illustrated in FIG. 4, this preferred embodiment of the panel 16 may be mounted onto an illustrative structural support member 30 by attaching channel members 33 onto the opposing edges of the support member 30. The edge portions 21 of the panel 10 may then be affixed within the channels 33 by any convenient means such as, for example, suitable fasteners. It should be understood that for the purposes of the present invention, however, the panel 16 could also be directly attached to the structural support member 30.

The present inventive adaptive architectural cover panel need not be restricted to convex configurations which are generally curved in cross-section such as the panel 16 shown in FIG. 2. By way of illustration, another preferred embodiment of an individual adaptive panel 22 of the present invention is further shown in FIG. 3. In this embodiment the panel 22 has a convex configuration which is generally truncated triangular in cross-section with the internal intersections 36 of the body portion 39 forming angles generally exceeding ninety degrees The body portion 39 is also provided with corrugations 42 generally oriented perpendicular to the longitudinal axis of the panel 22 and generally parallel to the cross-sectional plane of the panel 22. As shown in FIG. 3, the lateral sides of the truncated triangular cross-section can be intercorrugated with the top of the body portion 39. This embodiment may further, but need not necessarily, be provided with edge portions 45 attached to the lateral sides of the body portion 39 forming further corrugations 48 oriented parallel to and intersecting or merging with the corrugations 42 of the body portion 39 in an intercorrugated manner as shown in FIG. 3. As with the embodiment discussed above in connection with FIG. 2, the panel 22 of this embodiment can similarly be expanded and contracted along its entire length or width to adapt the panel 22 to structural support members of varying dimensions without specialized tailoring. Additionally, localized expansion and contraction of the corrugations 42 and 48 permit curvature of the panel 22 so as to adapt to the complex surface curvatures of various structural support members.

It will, of course, be understood that modifications of the present invention will be apparent to others skilled in the art. Consequently, the scope of the present should not be limited by the particular embodiments described above but should be defined only by the claims put forth below and equivalents thereof.

What is claimed is:

1. A method for covering the structural support members of an underlying structure, comprising attaching to said support members a plurality of contiguously arranged architectural cover panels of flexible material having a generally convex cross-section with corrugations formed therein extending transverse to a longitudinal axis of the panels, said corrugations enabling said cover panels to conform to the dimensions and surface curvature of the support members, said cover panels having edge portions formed along the longitudinal sides of said flexible material with corrugations formed therein oriented generally parallel to and intersecting the corrugations of said convex cross-section portion of the flexible material.

2. A method for covering the structural support members of an underlying structure with architectural cover panels as set forth in claim 1, wherein the architectural cover panels are intercorrugated such that the corrugations of said convex cross-sections are formed reversely to the corrugations of said edge portions, thereby strengthening the architectural cover panels in order for them to resist loading forces while also allowing them to conform to the surface curvature of the support members.

3. A method for covering the structural support members of an underlying structure with architectural cover panels as set forth in claim 1, wherein the architectural cover panels are attached to the underlying structural support members by means of channel members that are secured to the support members and are configured to receive and retain said sheet edge portions.

4. A method for covering the structural support members of an underlying structure, comprising attaching to said support members a plurality of contiguously arranged architectural cover panels of flexible material having a convex cross-section of a generally truncated triangular configuration with corrugations formed therein extending transverse to a longitudinal axis of the panels, said corrugations enabling said cover panels to conform to the dimensions and surface curvature of the support members.

5. A method for covering the structural support members of an underlying structure with architectural cover panels as set forth in claim 4, wherein the architectural cover panels are intercorrugated such that the truncated triangular cross-sections have lateral sides and tops with the corrugations on the lateral sides formed reversely to the corrugations on the tops, thereby strengthening the architectural cover panels in order for them to resist loading forces while also allowing them to conform to the surface curvature of the support members.

* * * * *